US010216206B1

(12) United States Patent
Wu

(10) Patent No.: US 10,216,206 B1
(45) Date of Patent: Feb. 26, 2019

(54) OPTICAL SENSOR DEVICE AND VOLTAGE REGULATOR APPARATUS WITH IMPROVED NOISE REJECTION CAPABILITY

(71) Applicant: PixArt Imaging Inc., Hsin-Chu (TW)

(72) Inventor: Chia-Ming Wu, Hsin-Chu (TW)

(73) Assignee: PixArt Imaging Inc., Hsin-Chu (TW)

( * ) Notice: Subject to any disclaimer, the term of this patent is extended or adjusted under 35 U.S.C. 154(b) by 18 days.

(21) Appl. No.: 15/672,322

(22) Filed: Aug. 9, 2017

(51) Int. Cl.
*G05F 1/46* (2006.01)

(52) U.S. Cl.
CPC ..... *G05F 1/467* (2013.01); *G05F 1/461* (2013.01)

(58) Field of Classification Search
CPC ..... G05F 1/461; G05F 1/467; G05F 1/468; G05F 1/565; G05F 1/595
See application file for complete search history.

(56) References Cited

U.S. PATENT DOCUMENTS 4,983,905 A * 1/1991 Sano ..... G05F 1/565 323/274
7,196,501 B1 * 3/2007 Dunipace ..... G05F 1/565 323/270
7,638,990 B1 * 12/2009 Shumarayev ..... G05F 1/56 323/271
7,675,273 B2 * 3/2010 Ko ..... G05F 1/575 323/269
2004/0056645 A1 * 3/2004 Inagaki ..... G05F 3/242 323/313
2010/0013448 A1 * 1/2010 Motz ..... G05F 1/575 323/280
2010/0141223 A1 * 6/2010 Wadhwa ..... G05F 1/56 323/280
2011/0115556 A1 * 5/2011 May ..... G05F 1/618 327/540
2011/0291745 A1 * 12/2011 Albean ..... G05F 3/16 327/535
2012/0105047 A1 * 5/2012 Huang ..... G05F 1/56 323/351
2013/0271100 A1 * 10/2013 El-Nozahi ..... G05F 1/468 323/280
2014/0266106 A1 * 9/2014 El-Nozahi ..... G05F 1/575 323/280
2015/0115918 A1 * 4/2015 Oikarinen ..... G05F 1/575 323/280
2015/0362936 A1 * 12/2015 Patel ..... G05F 1/575 323/280
2016/0334818 A1 * 11/2016 Singh ..... G05F 1/56
2017/0063223 A1 * 3/2017 Raghupathy ..... H02M 3/07
(Continued)

*Primary Examiner* — Fred E Finch, III
(74) *Attorney, Agent, or Firm* — Winston Hsu

(57) ABSTRACT

A voltage regulator apparatus with a rejection capability for high frequency power noise includes a low dropout linear regulator and a noise rejection circuit. The low dropout linear regulator has at least one operational amplifier which is powered by a power source, and the low dropout linear regulator is configured for receiving and regulating an input voltage signal to provide an output voltage signal for a load. The noise rejection circuit is coupled between the power source and the low dropout linear regulator, and is configured for providing a power noise rejection capability upon a high frequency part of a power signal of the power source to generate the power signal with less high frequency noise to the at least one operational amplifier.

4 Claims, 5 Drawing Sheets

(56) References Cited

U.S. PATENT DOCUMENTS

| | | | | |
|---|---|---|---|---|
| 2017/0097649 | A1* | 4/2017 | Lee | G05F 1/575 |
| 2017/0126329 | A1* | 5/2017 | Gorecki | G05F 1/565 |
| 2018/0046212 | A1* | 2/2018 | Ming | G05F 1/575 |

* cited by examiner

OPTICAL SENSOR DEVICE AND VOLTAGE REGULATOR APPARATUS WITH IMPROVED NOISE REJECTION CAPABILITY

BACKGROUND OF THE INVENTION

1. Field of the Invention

The invention relates to a power noise rejection mechanism, and more particularly to a voltage regulator apparatus with improved noise rejection capability for power noise, and an optical sensor device including such apparatus.

2. Description of the Prior Art

Generally speaking, a conventional low dropout linear regulator has an operational amplifier-based circuit structure, and its performance is limited by the operational amplifier-based circuit structure. The conventional low dropout linear regulator cannot provide a broadband power noise rejection capability. For example, the performance of an image sensor is more sensitive to noise at frequency from 1 KHz to 100 MHz. If the image sensor implemented with the conventional low dropout linear regulator, the performance of such image sensor will become more sensitive to power noise at frequency from 1 KHz to 100 MHz. Thus, the quality of images generated by such image sensor will be degraded. Accordingly, it is important to provide a novel low dropout linear regulator with a broadband power noise rejection capability.

SUMMARY OF THE INVENTION

Therefore one of the objectives of the invention is to provide a voltage regulator apparatus with improved noise rejection capability for power noise, and an optical sensor device including such apparatus, to solve the above-mentioned problem.

According to embodiments of the invention, a voltage regulator apparatus with a rejection capability for high frequency power noise is disclosed. The voltage regulator apparatus comprises a low dropout linear regulator and a noise rejection circuit. The low dropout linear regulator has at least one operational amplifier which is powered by a power source, and the low dropout linear regulator is configured for receiving and regulating an input voltage signal to provide an output voltage signal for a load. The noise rejection circuit is coupled between the power source and the low dropout linear regulator, and is configured for providing a power noise rejection capability upon a high frequency part of a power signal of the power source to generate the power signal with less high frequency noise to the at least one operational amplifier.

According to the embodiments, an optical sensor device comprising the above-mentioned voltage regulator apparatus is disclosed.

According to the embodiments, the voltage regulator apparatus with improved noise rejection capability for power noise can provide a broadband power noise rejection capability. For instance, the voltage regulator apparatus can provide noise rejection capability for frequency from 1 KHz to 1 GHz.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
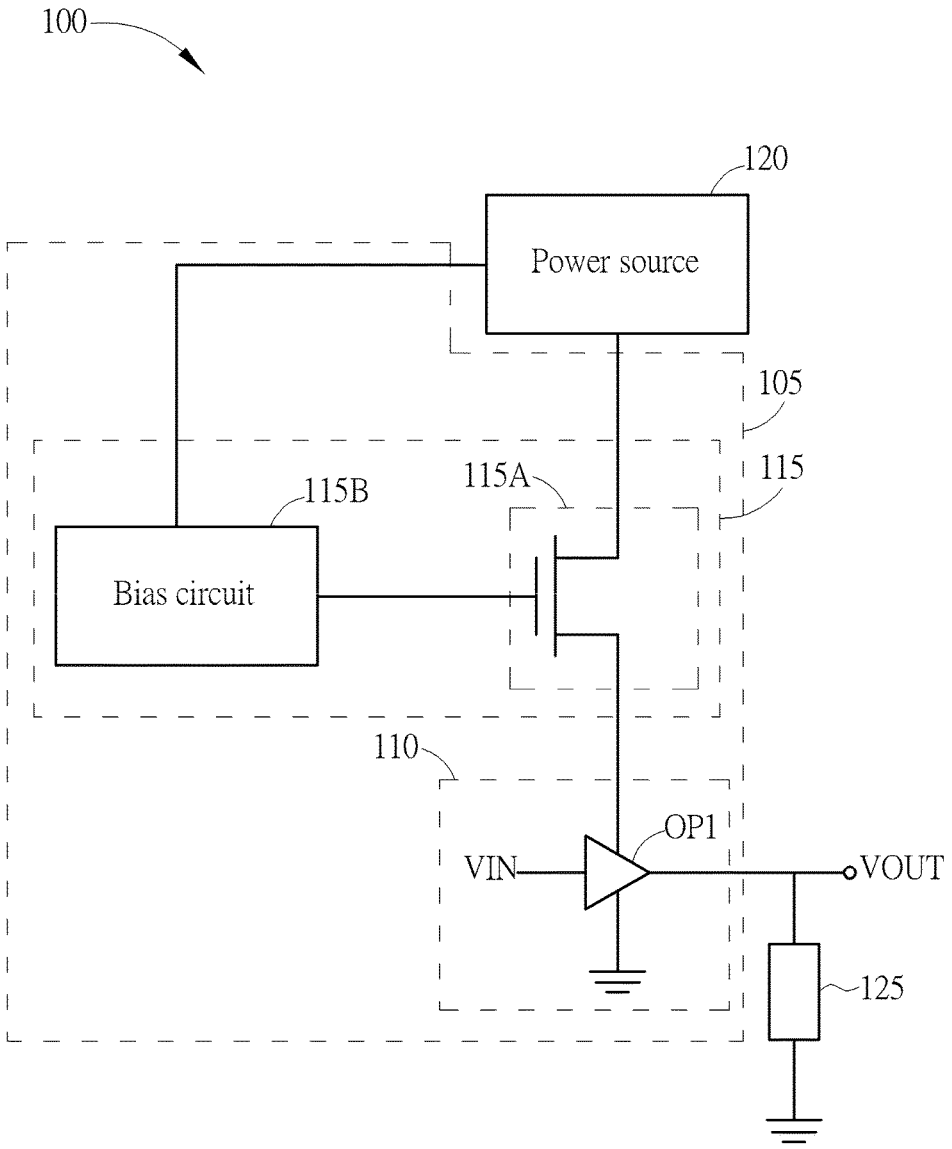
FIG. 1 is a diagram of an optical sensor device according to an embodiment of the invention.

Refer to FIG. 1, which is a diagram of an optical sensor device 100 according to an embodiment of the invention. The optical sensor device 100 such as an image sensor device comprises a voltage regulator apparatus 105. The voltage regulator apparatus 105 has a noise/ripple rejection capability for decreasing or avoiding/rejecting power noise/ripple such as high frequency power noise. The voltage regulator apparatus 105 comprises a linear regulator such as a low dropout linear regulator 110 and a noise rejection circuit 115. The voltage regulator apparatus 105 employs the low dropout linear regulator 110 to receive and regulate an input voltage signal VIN to generate/provide an output voltage signal VOUT for a load 125. The power of low dropout linear regulator 110 is provided by the power source 120 through the noise rejection circuit 115, and the noise rejection circuit 115 is arranged to avoid or reject power noise from the power source 120, e.g. high frequency power noise, affecting the signal, operation, and/or performance of the low dropout linear regulator 110, In this embodiment, the low dropout linear regulator 110 has at least one operational amplifier (but not limited) which is powered by a power source 120. For example, in the embodiment, the low dropout linear regulator 110 has an operational amplifier OP1 having an input for receiving and regulating the input voltage signal VIN to generate/provide the output voltage signal VOUT for the load 125 which is connected between the output of operational amplifier OP1 and the ground level. The operational amplifier OP1 is powered by the power source 120. The performance of operational amplifier OP1 is easily affected by power noise such as high frequency power noise. Thus, the noise rejection circuit 115 is arranged to be placed/configured between the power source 120 and low dropout linear regulator 110, to reject or avoid the high frequency power noise from power source 120 so as to avoid the performance of low dropout linear regulator 110 be affected by the high frequency power noise.

Specifically, in practice, the noise rejection circuit 115 comprises a transistor 115A and a bias circuit 115B wherein the transistor 115A is used as a noise rejection element which is placed/configured between the power source 120 and low dropout linear regulator 110. The bias circuit 115B is used for generating and providing a bias signal such as a voltage bias signal VB to the control terminal of transistor 115A to maintain conductance of transistor 115A so as to provide noise rejection capability. The transistor 115A such as an MOS transistor (e.g. NMOS transistor) with a regular voltage threshold (RVT), a low voltage threshold (LVT) or a zero voltage threshold has a first terminal connected to power source 120, a second terminal connected to a power input of the operational amplifier OP1, and the control terminal such as the gate connected to the voltage bias signal VB. The bias circuit 115B in an example is arranged to provide a band gap reference voltage to the gate of transistor 115A. In other examples, the bias circuit 110B may be implemented by using an R-C filter. These modifications all fall within the scope of the invention.

Figure 2:
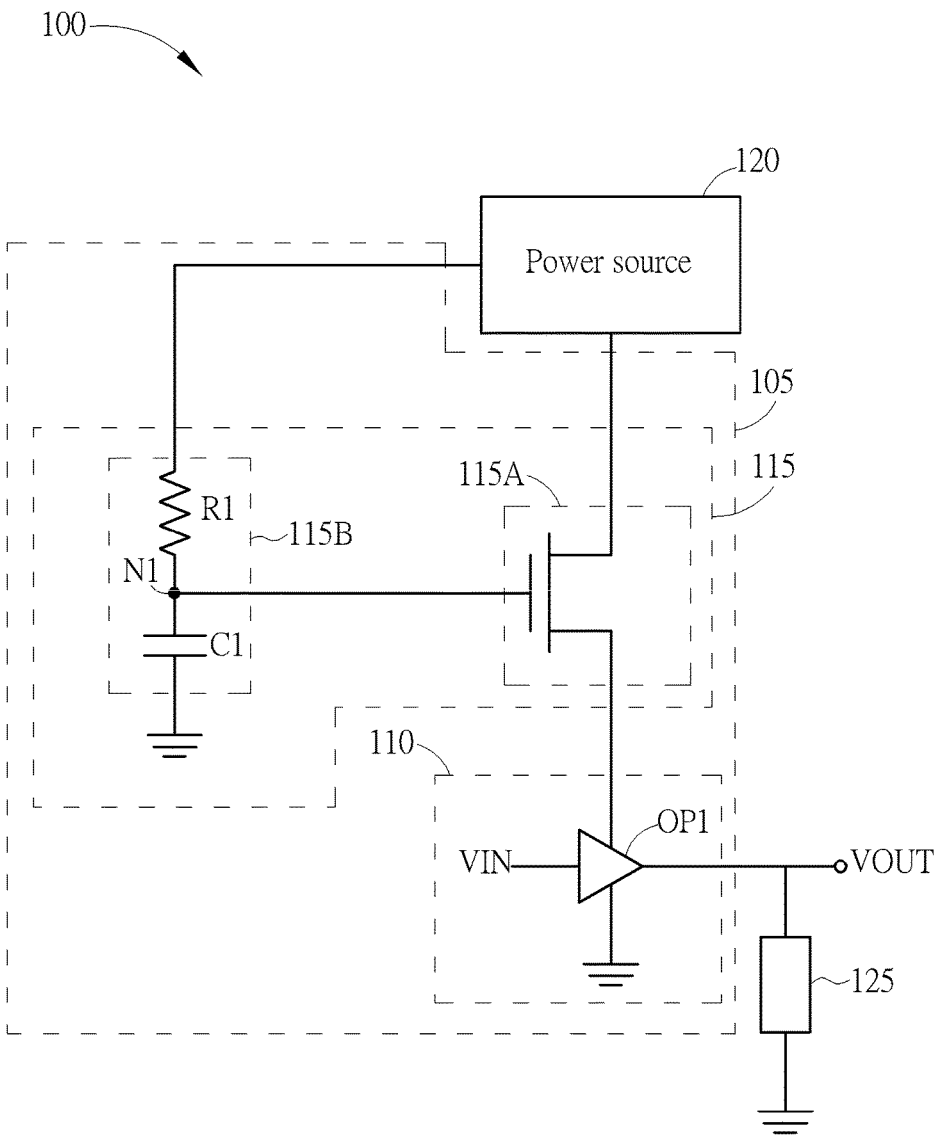
FIG. 2 is a diagram illustrating an example of optical sensor device as shown in FIG. 1.

The bias circuit 115B can be implemented using a set of resistor and capacitor. FIG. 2 is a diagram illustrating an example of optical sensor device 100 as shown in FIG. 1. The bias circuit 115B comprises a resistor R1 and capacitor C1. A first terminal of resistor R1 is connected to the power source and a second terminal of resistor R1 is connected to an intermediate terminal N1 of bias circuit 115B. The first terminal of capacitor C1 is connected to the intermediate terminal N1, and the second terminal of capacitor C1 is connected to the ground level. The intermediate terminal N1 is connected to the control terminal of transistor 115A, and the voltage bias signal VB is generated at the intermediate terminal N1 and provided for the gate of NMOS transistor 115A.

Figures 3, 4, 5:
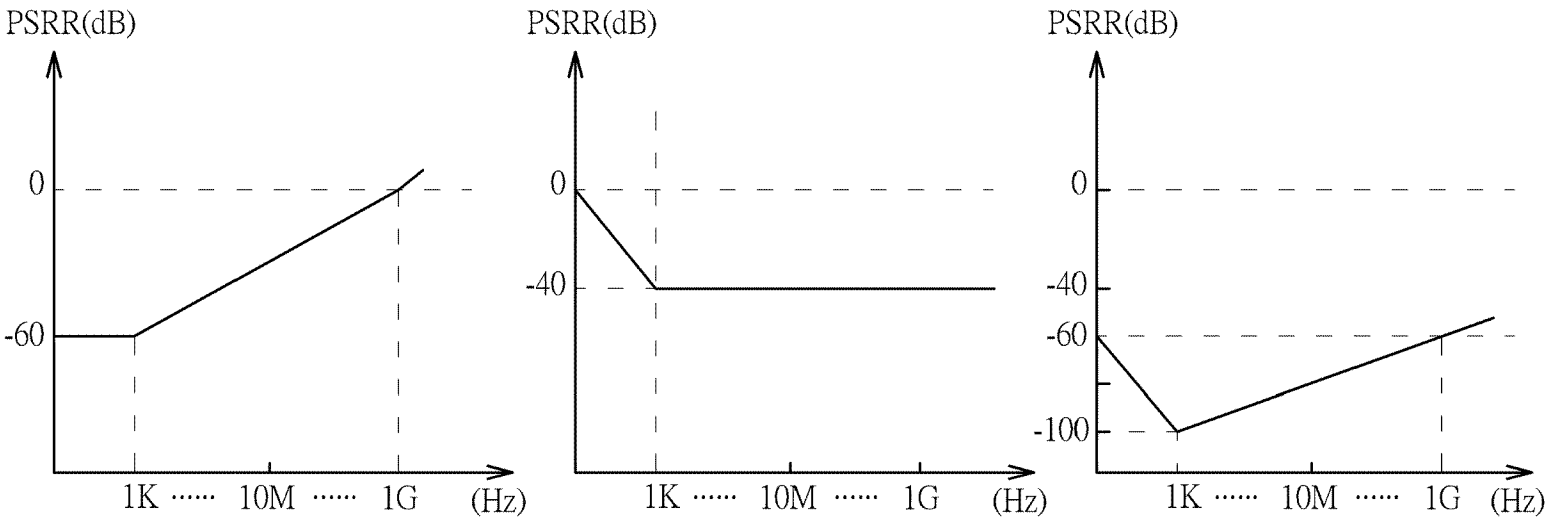
FIG. 3 is a diagram showing a simplified example of the power supply rejection ratio (PSRR) frequency response of low dropout linear regulator as shown in FIG. 2.
FIG. 4 is a diagram showing a simplified example of the PSRR frequency response of noise rejection circuit as shown in FIG. 2.
FIG. 5 is a diagram showing a simplified example of the PSRR frequency response of voltage regulator apparatus of FIG. 2.

Refer to FIG. 3 in conjunction with FIG. 4 and FIG. 5. FIG. 3 is a diagram showing a simplified example of the power supply rejection ratio (PSRR) frequency response of low dropout linear regulator 110 as shown in FIG. 2. FIG. 4 is a diagram showing a simplified example of the PSRR frequency response of noise rejection circuit 115 as shown in FIG. 2. FIG. 5 is a diagram showing a simplified example of the PSRR frequency response of voltage regulator apparatus 105 of FIG. 2. The PSRR value is used to describe the capability of an electronic circuit to suppress any power supply variations to its output signal. As shown in the example of FIG. 3, the low dropout linear regulator 110 has the comparatively large negative PSRR (e.g. −60 dB) at lower frequency e.g. 0-1 KHz. The low dropout linear regulator 110 has comparatively small negative PSRR at higher frequency. The low dropout linear regulator 110 has a better noise rejection capability for power noise at a specific frequency if the negative PSRR value at the specific frequency is larger. In addition, the PSRR at 1 GHz above becomes zero. This indicates that the low dropout linear regulator 110 does not have the noise rejection capability for power noise at the frequency above 1 GHz.

As shown the example of in FIG. 4, the noise rejection circuit 115 is employed. The noise rejection circuit 115 has a comparatively small negative PSRR (e.g. 0 dB−−40 dB) at lower frequency such as 0-1 KHz. For the power nose at higher frequency such as above 1 KHz, the noise rejection circuit 115 has and provides −40 dB rejection capability. Thus, as shown in FIG. 5, the improved PSRR frequency response of voltage regulator apparatus 105 shows that the using the noise rejection circuit 115 can further provide −40 dB rejection capability for the higher frequency such as 1 KHz-1 GHz. For example, for the frequency at 1 KHz, the voltage regulator apparatus 105 provides −100 dB noise rejection capability.

Figure 6:
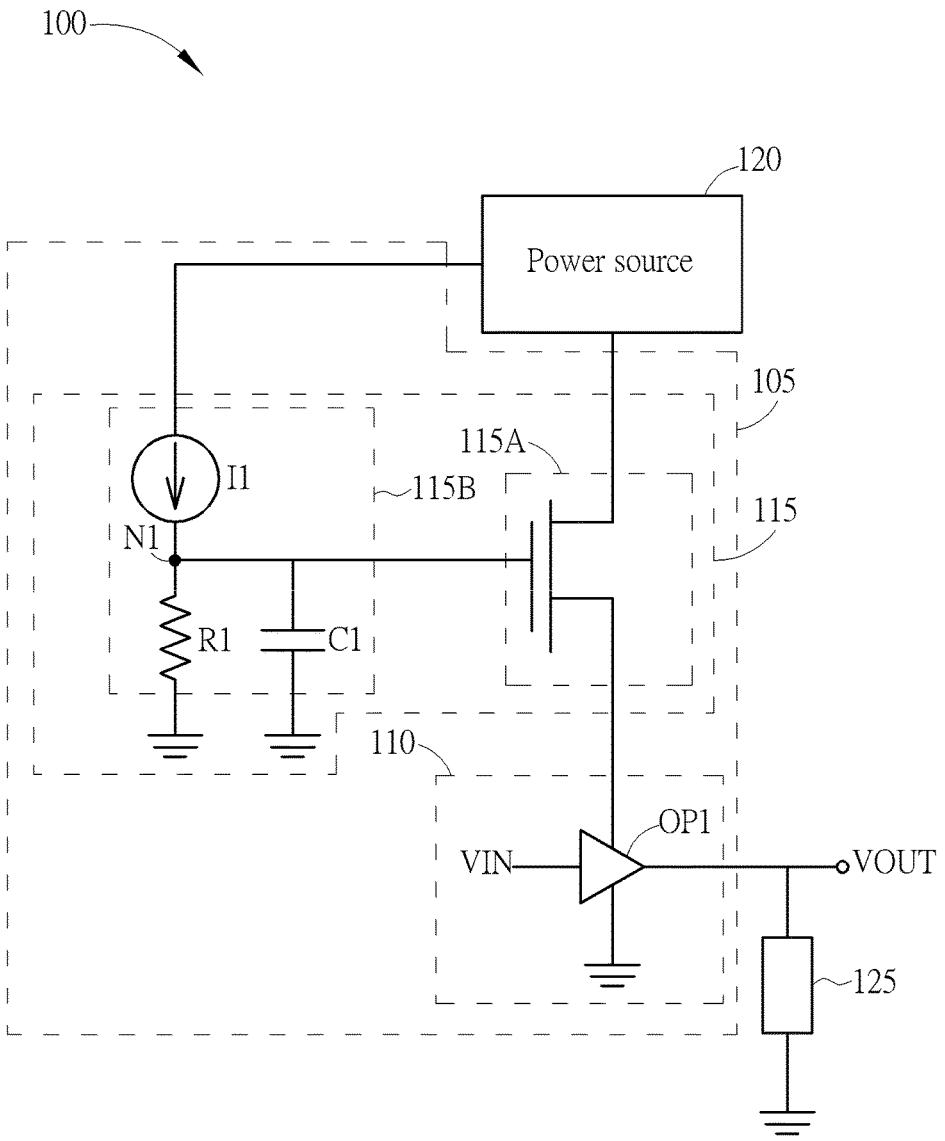
FIG. 6 is a diagram illustrating another example of optical sensor device as shown in FIG. 1.

Further, in another embodiment, the bias circuit 115B can be implemented using a set of resistor, capacitor, and a current source circuit. FIG. 6 is a diagram illustrating another example of optical sensor device 100 as shown in FIG. 1. The bias circuit 115B comprises resistor R1, capacitor C1, and a current source circuit I1. The current source circuit I1 such as a reference current source or band-gap current source has a terminal connected to the power source 120 and another terminal connected to the intermediate terminal of bias circuit 115B, and is used for providing a specific reference current. The resistor R1 and capacitor C1 are connected in parallel. The first terminal of resistor R1 is connected to the intermediate terminal N1 of bias circuit 115B and the second terminal of resistor R1 is connected to the ground level. Also, the first terminal of capacitor C1 is connected to the intermediate terminal N1 of bias circuit 115B and the second terminal of capacitor C1 is connected to the ground level. The intermediate terminal N1 is connected to the control terminal (i.e. gate) of transistor 115A. The voltage bias signal VB is generated at the intermediate terminal N1 and provided for the gate of NMOS transistor 115A.

Figure 7:
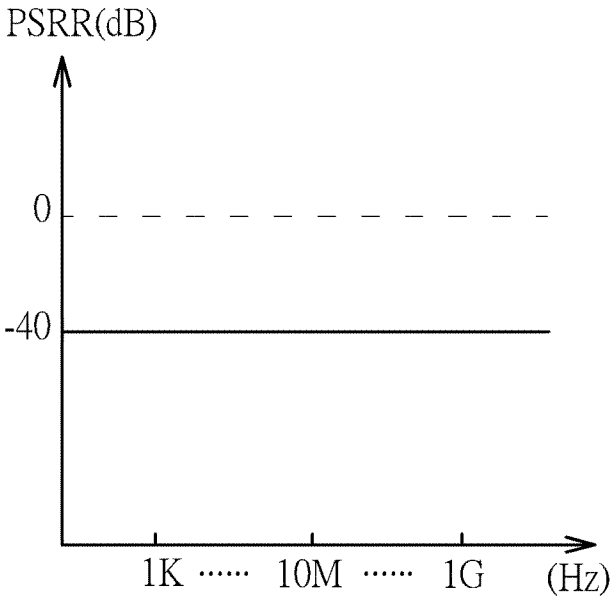
FIG. 7 is a diagram showing a simplified example of the PSRR frequency response of noise rejection circuit as shown in FIG. 6.
Figure 8:
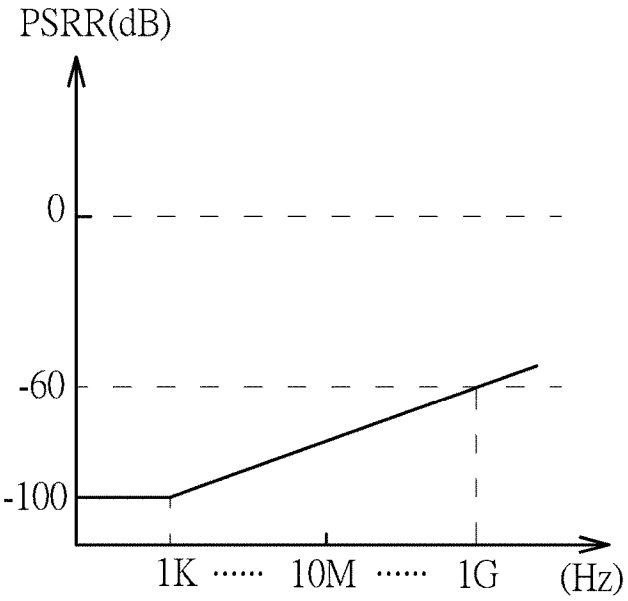
FIG. 8 is a diagram showing a simplified example of the PSRR frequency response of voltage regulator apparatus of FIG. 6.

Refer to FIG. 3 again and in conjunction with FIG. 7 and FIG. 8. FIG. 7 is a diagram showing a simplified example of the PSRR frequency response of noise rejection circuit 115 as shown in FIG. 6. FIG. 8 is a diagram showing a simplified example of the PSRR frequency response of voltage regulator apparatus 105 of FIG. 6. As shown in the example of FIG. 3, the low dropout linear regulator 110 has the comparatively large negative PSRR (e.g. −60 dB) at lower frequency e.g. 0-1 KHz. The low dropout linear regulator 110 has comparatively small negative PSRR at higher frequency. The low dropout linear regulator 110 has a better noise rejection capability for power noise at a specific frequency if the negative PSRR value at the specific frequency is larger. In addition, the PSRR at 1 GHz above becomes zero. This indicates that the low dropout linear regulator 110 does not have the noise rejection capability for power noise at the frequency above 1 GHz. As shown the example of in FIG. 7, the PSRR of the noise rejection circuit 115 is −40 dB for any frequency. That is, the noise rejection circuit 115 of FIG. 6 provides −40 dB noise rejection capability for any frequency. Thus, as shown in FIG. 8, the improved PSRR frequency response of voltage regulator apparatus 105 shows that the using the noise rejection circuit 115 can provide −100 dB rejection capability for the lower frequency from zero to 1 KHz and at least greater than −40 dB rejection capability for the frequency from 1 KHz to 1 GHz. Also, the noise rejection circuit 115 can provide −40 dB noise rejection capability for the frequency higher than 1 GHz.

Compared to the conventional schemes which are limited due to the operation of operational amplifier, the above embodiments can provide better power noise rejection capability for the higher frequency such as frequency from 1 KHz to 1 GHz. Particularly, for an optical sensor device/application such an image sensor device implemented with such power noise rejection capability, the quality of generated/sensed images will not be degraded.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A voltage regulator apparatus with a rejection capability for high frequency power noise, comprising:

a low dropout linear regulator having at least one operational amplifier which is powered by a power source, the low dropout linear regulator being configured for receiving and regulating an input voltage signal to provide an output voltage signal for a load; and a noise rejection circuit, coupled between the power source and the low dropout linear regulator, configured for providing a power noise rejection capability upon a high frequency part of a power signal of the power source to generate the power signal with less high frequency noise to the at least one operational amplifier;

wherein the noise rejection circuit comprises:

a transistor used as a noise rejection element, having a first terminal connected to the power source, a second terminal connected to a power input of the at least one operational amplifier, and a control terminal connected to a voltage bias signal;

a resistor, having a first terminal connected to the power source and a second terminal connected to the control terminal of the transistor; and a capacitor, having a first terminal connected to the control terminal of the transistor and a second terminal connected to a ground level;

wherein the voltage bias signal is generated from an intermediate node between the resistor and the capacitor, and wherein the voltage bias signal is irrelevant to the input voltage signal.

2. The voltage regulator of claim 1, wherein the transistor is a MOS transistor with a low voltage threshold.

3. An optical sensor device comprising the voltage regulator apparatus of claim 1.

4. A voltage regulator apparatus with a rejection capability for high frequency power noise, comprising:

a low dropout linear regulator having at least one operational amplifier which is powered by a power source, the low dropout linear regulator being configured for receiving and regulating an input voltage signal to provide an output voltage signal for a load; and a noise rejection circuit, coupled between the power source and the low dropout linear regulator, configured for providing a power noise rejection capability upon a high frequency part of a power signal of the power source to generate the power signal with less high frequency noise to the at least one operational amplifier;

wherein the noise rejection circuit comprises:

a transistor used as a noise rejection element, having a first terminal connected to the power source, a second terminal connected to a power input of the at least one operational amplifier, and a control terminal connected to a voltage bias signal; and a bias circuit, coupled to the control terminal of the transistor, configured for providing the voltage bias signal to the control terminal of the transistor, the bias circuit being powered by the power signal and the voltage bias signal generated from the bias circuit being irrelevant to the input voltage signal.

* * * * *